US009920959B2

(12) United States Patent
Gong

(10) Patent No.: US 9,920,959 B2
(45) Date of Patent: Mar. 20, 2018

(54) REFRIGERATION DEVICE

(71) Applicant: Bingxin Gong, Guangdong (CN)

(72) Inventor: Bingxin Gong, Guangdong (CN)

( * ) Notice: Subject to any disclaimer, the term of this patent is extended or adjusted under 35 U.S.C. 154(b) by 0 days.

(21) Appl. No.: 15/397,758

(22) Filed: Jan. 4, 2017

(65) Prior Publication Data

US 2017/0138640 A1 May 18, 2017

Related U.S. Application Data

(63) Continuation of application No. PCT/CN2015/082589, filed on Jun. 28, 2015.

(30) Foreign Application Priority Data

Jul. 4, 2014 (CN) ..... 2014 1 0319675

(51) Int. Cl.

| | |
|---|---|
| ***F25B 1/00*** | (2006.01) |
| ***F01B 3/00*** | (2006.01) |
| ***F01B 25/10*** | (2006.01) |
| ***F25B 41/04*** | (2006.01) |

(52) U.S. Cl.

CPC ..... *F25B 1/00* (2013.01); *F01B 3/002* (2013.01); *F01B 3/0005* (2013.01); *F01B 3/0085* (2013.01); *F01B 25/10* (2013.01); *F25B 41/04* (2013.01); *F25B 2400/14* (2013.01)

(58) Field of Classification Search

CPC ..... F25B 1/00; F25B 41/04; F25B 2400/14; F25B 25/005; F25B 30/02; F25B 2400/0409; F25B 2400/0411; F01B 3/0005; F01B 3/002; F01B 3/0085; F01B 25/10

USPC ..... 62/116, 149

See application file for complete search history.

(56) References Cited

U.S. PATENT DOCUMENTS

| | | | | |
|---|---|---|---|---|
| 5,383,342 A * | 1/1995 | El-Boher | ..... | F25B 1/00 62/123 |
| 2004/0074246 A1* | 4/2004 | Kurata | ..... | B60H 1/00328 62/196.4 |
| 2010/0170295 A1* | 7/2010 | Okazaki | ..... | F04C 18/0215 62/510 |

FOREIGN PATENT DOCUMENTS

| | | |
|---|---|---|
| CN | 102829569 A | 12/2012 |
| CN | 103868266 A | 6/2014 |
| WO | 2014040482 A1 | 3/2014 |

OTHER PUBLICATIONS

1st Office Action of counterpart Chinese Patent Application No. 201410319675.2 dated Dec. 28, 2015.

* cited by examiner

*Primary Examiner* — Mohammad M Ali

(57) ABSTRACT

A refrigeration device includes a compressor, a condenser, an expansion valve, an evaporator, intake electromagnetic valves and exhaust electromagnetic valves, two-position three-way electromagnetic valves or two-position five-way electromagnetic valves, a cylinder group, a volume-variable airproof container, two-position two-way electromagnetic valves and a generator. The cylinder group is composed of two or more cylinders, refrigerant flows successively through the compressor, the intake electromagnetic valves, the cylinder group, the exhaust electromagnetic valves, the condenser, the expansion valve and the evaporator and finally enters the compressor from the evaporator, the cylinder group can do work to generate electricity through atmospheric pressure in the volume-variable airproof container and compensates for electric energy consumed by the compressor, and therefore the electric energy can be saved.

5 Claims, 1 Drawing Sheet

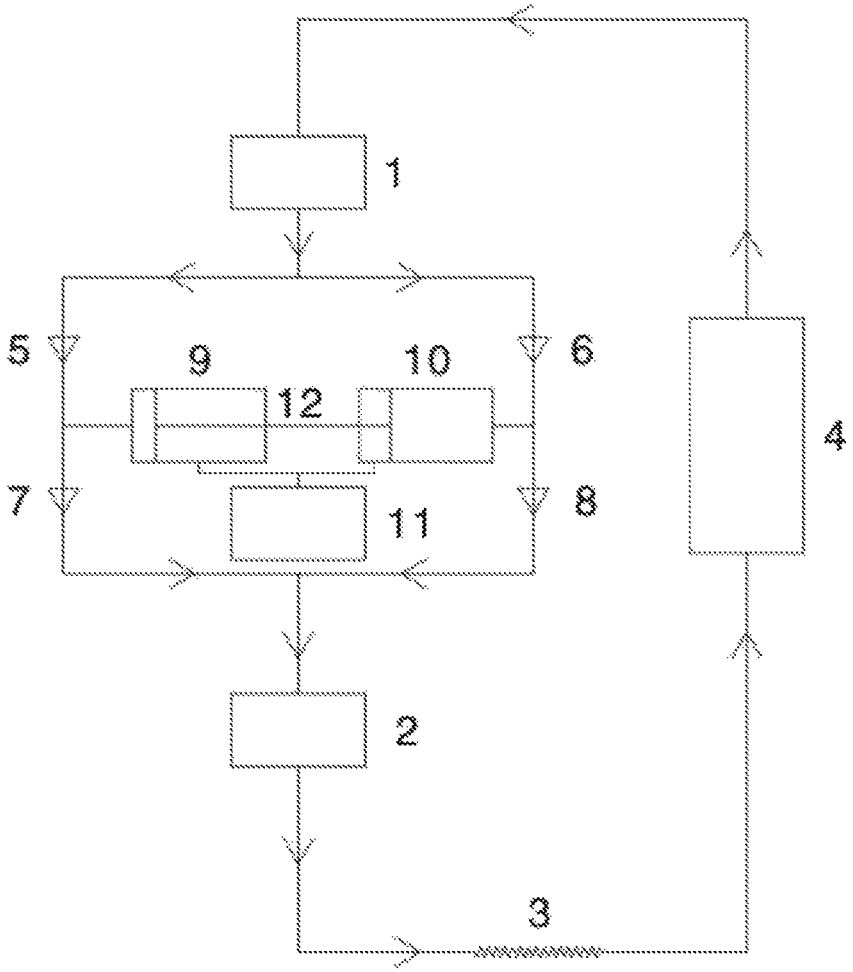
1
5
9
10
6
12
4
7
11
8
2
3

REFRIGERATION DEVICE

CROSS-REFERENCE TO RELATED APPLICATIONS

The present application is a Continuation Application of PCT application No. PCT/CN2015/082589 filed on Jun. 28, 2015, which claims the benefit of Chinese Patent Application No. 201410319675.2 filed on Jul. 4, 2014, the contents of which are hereby incorporated by reference.

TECHNICAL FIELD

This refrigeration device asides comprises a compressor, a condenser, an expansion valve, an evaporator, intake electromagnetic valves and exhaust electromagnetic valves, two-position three-way electromagnetic valves or two-position five-way electromagnetic valves, a cylinder group, a volume-variable airproof container, a two-position two-way electromagnetic valve and a generator, the cylinder group is composed of two or more cylinders, refrigerant flows successively through the compressor, the intake electromagnetic valves, the cylinder group, the exhaust electromagnetic valves, the condenser, the expansion valve and the evaporator and finally enters the compressor from the evaporator, the cylinder group can do work to generate electricity through atmospheric pressure in the volume-variable airproof container and compensates for electric energy consumed by the compressor, and therefore the electric energy can be saved.

BACKGROUND

We know that a traditional refrigeration device consumes very much power, and the traditional refrigeration device can not uses outside atmospheric pressure to work to generate electricity and compensates for electric energy consumed by the compressor, and the world faces the problems of global warming and increasing depletion of fossil fuels.

SUMMARY OF THE INVENTION

In order to solve the above-mentioned problems, the present invention provides an energy-saving refrigeration device. This refrigeration device comprises a compressor, a condenser, an expansion valve, an evaporator, intake electromagnetic valves and exhaust electromagnetic valves, two-position three-way electromagnetic valves or two-position five-way electromagnetic valves, a cylinder group, a volume-variable airproof container, two-position two-way electromagnetic valves, a generator, and a three-way tube; the intake electromagnetic valves and the exhaust electromagnetic valves are normally closed valves; the cylinder group consists of two or more cylinders, the cylinders are double-acting cylinders, a pipeline from the compressor to the cylinders are wrapped with a heat preservation material, and the cylinders are made of a material with good performance of heat insulation; the area affected by a force on a side of the cylinders without a rod is lager than the area affected by a force on a side with a piston rod of the cylinders, the force affected on the side without a rod of the cylinders is larger or equal to the sum of the force affected on the side with the piston rod of the cylinders plus the frictional force of the piston and a cylinder wall, and the area affected by a force on a side with a piston rod of the cylinders is larger or equal to an effective cross-sectional area of a condenser tube; an air hole on the side of the cylinders with a piston rod is connected to the volume-variable airproof container, when the refrigeration device is in operation, the gas pressure in the airproof container is equal to or higher than the refrigerant liquefaction pressure of the refrigerant at the environmental temperature, the gas pressure in the airproof container is larger than or equal to an outlet pressure of the compressor; an air hole on the side of the cylinders without a rod is connected to one three-way tube, one opening of the three-way tube is connected to the cylinder via one filter, the function of the filter is to prevent impurities from entering into the intake electromagnetic valves and the exhaust electromagnetic valves, the other two openings are respectively connected to the intake electromagnetic valves and the exhaust electromagnetic valves, the intake electromagnetic valves are connected to the compressor, and the exhaust electromagnetic valves are connected to the condenser; when the piston is pushed to the top of the cylinder by the refrigerant from the compressor, the intake electromagnetic valves close and the exhaust electromagnetic valves open, the piston is pressed towards the bottom of the cylinder by atmospheric pressure in the airproof container, when the piston is pressed to the bottom of the cylinder by the atmospheric pressure in the airproof container, the exhaust electromagnetic valves close, the intake electromagnetic valves open, and the refrigerant from the compressor enters into the cylinder again; the refrigerant flows successively through the compressor, the intake electromagnetic valves, the cylinder group, the exhaust electromagnetic valves, the condenser, the expansion valve and the evaporator and finally enters the compressor from the evaporator, the cylinder group can do work to generate electricity through atmospheric pressure in the volume-variable airproof container and compensates for electric energy consumed by the compressor.

The two-position three-way electromagnetic valve or two-position five-way electromagnetic valve can replace the intake electromagnetic valves and the exhaust electromagnetic valves to control the air inlet and air outlet of the cylinders.

The structure of said volume-variable airproof container, one piston is provided in the airproof container, the volume of the airproof container is varied by the movement of the piston so as to change the gas pressure of the airproof container.

The air hole on the side of the cylinders with a piston rod is connected to the volume-variable airproof container, refrigeration oil is filled on the side of the cylinders with a piston rod, in addition to the function of lubrication, the refrigeration oil also has the function of separation which separates the gas in the volume-variable airproof container from the refrigerant so as to prevent the gas in the volume-variable airproof container from entering into the side without a rod of the cylinders to contaminate the refrigerant.

When the intake electromagnetic valve of one cylinder opens, the exhaust electromagnetic valve closes; and at the same time, the intake electromagnetic valve of the other cylinder closes, and the exhaust electromagnetic valve of the cylinder opens.

BRIEF DESCRIPTION OF THE DRAWINGS

The FIGURE is a schematic diagram of the refrigeration device of the present invention.

In the FIGURE: 1. compressor; 2. condenser; 3. capillary tube; 4. evaporator; 5. intake electromagnetic valve; 6. intake electromagnetic valve; 7. exhaust electromagnetic valve; 8. exhaust electromagnetic valve; 9. cylinder; 10. cylinder; 11. airproof container; 12. piston rod.

DETAILED DESCRIPTION

Referring to the FIGURE, one particular embodiment is described below, and a specific embodiment is not limited to this embodiment.

An energy-saving refrigeration device is very similar to a traditional refrigeration device, and therefore the traditional refrigeration device can be modified into the energy-saving refrigeration device.

In order to modify the traditional refrigeration device into the energy-saving refrigeration device, it is required to mount intake electromagnetic valves, exhaust electromagnetic valves, and a cylinder group between a compressor outlet and a condenser inlet of the traditional refrigeration device.

The cylinder group consists of two cylinders, the cylinders are double-acting cylinders, a pipeline from the compressor to the cylinders are wrapped with a heat preservation material, and the cylinders are made of a material with good performance of heat insulation; and an air hole on the side of the cylinders with a piston rod is connected to the volume-variable airproof container.

When the intake electromagnetic valve of one cylinder opens, the exhaust electromagnetic valve closes; and at the same time, the intake electromagnetic valve of the other cylinder closes, and the exhaust electromagnetic valve of the cylinder opens.

An air hole on the side of the cylinders without a rod is connected to one three-way tube, one opening of the three-way tube is connected to the cylinder via one filter, the other two openings are respectively connected to the intake electromagnetic valves and the exhaust electromagnetic valves, the intake electromagnetic valves are connected to the compressor, and the exhaust electromagnetic valves are connected to the condenser; when the piston is pushed to the top of the cylinder by the refrigerant from the compressor, the intake electromagnetic valves close and the exhaust electromagnetic valves open, the piston is pressed towards the bottom of the cylinder by atmospheric pressure in the airproof container, when the piston is pressed to the bottom of the cylinder by the atmospheric pressure in the airproof container, the exhaust electromagnetic valves close, and the intake electromagnetic valves open.

When the refrigeration device is in operation, the gas pressure in the airproof container is equal to or higher than the refrigerant liquefaction pressure, the gas pressure in the airproof container is larger than or equal to an outlet pressure of the compressor; for example, if R134a is the refrigerant, the environment temperature is 30 degrees, the liquefaction pressure of the R134a at 30 degrees is equal to 0.7702 MPa, the gas pressure in the airproof container should be equal to or higher than 0.7702 MPa, and considering flow resistance, the gas pressure in the airproof container is 0.9 MPa.

The refrigerant flows successively through the compressor, the intake electromagnetic valves, the cylinder group, the exhaust electromagnetic valves, the condenser, the expansion valve and the evaporator and finally enters the compressor from the evaporator, the cylinder group can do work to generate electricity through atmospheric pressure in the volume-variable airproof container and compensates for electric energy consumed by the compressor.

When the exhaust valves of the cylinders open, since the refrigerant will condense into a liquid state in the condenser, the pressure decreases, the pressure difference between the airproof container and the condenser will push the piston so as to drive the generator to generate electricity and compensates for electric energy consumed by the compressor; and on the other hand, the gas pressure in the airproof container can condense the refrigerant so as to reduce the electric energy consumption of the compressor, achieving the purpose of energy saving.

What is claimed is:

1. A refrigeration device, wherein the refrigeration device comprises a compressor, a condenser, an expansion valve, an evaporator, intake electromagnetic valves and exhaust electromagnetic valves, two-position three-way electromagnetic valves or two-position five-way electromagnetic valves, a cylinder group, a volume-variable airproof container, two-position two-way electromagnetic valves, a generator, and a three-way tube; the intake electromagnetic valves and the exhaust electromagnetic valves are normally closed valves; the cylinder group consists of two or more cylinders, the cylinders are double-acting cylinders, a pipeline from the compressor to the cylinders are wrapped with a heat preservation material, and the cylinders are made of a material with good performance of heat insulation; the area affected by a force on a side of the cylinders without a rod is larger than the area affected by a force on a side with a piston rod of the cylinders, the force affected on the side without a rod of the cylinders is larger or equal to the sum of the force affected on the side with the piston rod of the cylinders plus the frictional force of the piston and a cylinder wall, and the area affected by a force on a side with a piston rod of the cylinders is larger or equal to an effective cross-sectional area of a condenser tube; an air hole on the side of the cylinders with a piston rod is connected to the volume-variable airproof container, when the refrigeration device is in operation, the gas pressure in the airproof container is equal to or higher than the refrigerant liquefaction pressure of the refrigerant at the environmental temperature, the gas pressure in the airproof container is larger than or equal to an outlet pressure of the compressor; an air hole on the side of the cylinders without a rod is connected to one three-way tube, one opening of the three-way tube is connected to the cylinder via one filter, the function of the filter is to prevent impurities from entering into the intake electromagnetic valves and the exhaust electromagnetic valves, the other two openings are respectively connected to the intake electromagnetic valves and the exhaust electromagnetic valves, the intake electromagnetic valves are connected to the compressor, and the exhaust electromagnetic valves are connected to the condenser; when the piston is pushed to the top of the cylinder by the refrigerant from the compressor, the intake electromagnetic valves close and the exhaust electromagnetic valves open, the piston is pressed towards the bottom of the cylinder by atmospheric pressure in the airproof container, when the piston is pressed to the bottom of the cylinder by the atmospheric pressure in the airproof container, the exhaust electromagnetic valves close, the intake electromagnetic valves open, and the refrigerant from the compressor enters into the cylinder again; the refrigerant flows successively through the compressor, the intake electromagnetic valves, the cylinder group, the exhaust electromagnetic valves, the condenser, the expansion valve and the evaporator and finally enters the compressor from the evaporator, the cylinder group can do work to generate electricity through atmospheric pressure in the volume-variable airproof container and compensates for electric energy consumed by the compressor.

2. The refrigeration device according to claim 1, wherein the two-position three-way electromagnetic valve or two-position five-way electromagnetic valve can replace the intake electromagnetic valves and the exhaust electromagnetic valves to control the air inlet and air outlet of the cylinders.

3. The refrigeration device according to claim 1, wherein in the structure of the volume-variable airproof container, one piston is provided in the airproof container, the volume of the airproof container is varied by the movement of the piston so as to change the gas pressure of the airproof container.

4. The refrigeration device according to claim 1, wherein when the intake electromagnetic valve of one cylinder of the two cylinders of the cylinder group opens, the exhaust electromagnetic valve closes; and at the same time, the intake electromagnetic valve of the other cylinder closes, and the exhaust electromagnetic valve of the cylinder opens.

5. The refrigeration device according to claim 1, wherein the air hole on the side of the cylinders with a piston rod is connected to the volume-variable airproof container, refrigeration oil is filled on the side of the cylinders with a piston rod, in addition to the function of lubrication, the refrigeration oil also has the function of separation which separates the gas in the volume-variable airproof container from the refrigerant so as to prevent the gas in the volume-variable airproof container from entering into the side without a rod of the cylinders to contaminate the refrigerant.

* * * * *